US006932224B1

(12) United States Patent
Sandberg

(10) Patent No.: US 6,932,224 B1
(45) Date of Patent: Aug. 23, 2005

(54) LOCKABLE FISHING ROD RACK

(76) Inventor: Robert J. Sandberg, P.O. Box 1235, Sarasota, FL (US) 34230

( * ) Notice: Subject to any disclaimer, the term of this patent is extended or adjusted under 35 U.S.C. 154(b) by 228 days.

(21) Appl. No.: 10/625,864

(22) Filed: Jul. 23, 2003

Related U.S. Application Data

(60) Provisional application No. 60/400,350, filed on Jul. 31, 2002.

(51) Int. Cl.[7] ..... A47F 7/00
(52) U.S. Cl. ..... 211/70.8
(58) Field of Search ..... 211/70.8, 60.1, 211/64, 4, 8, 9, 7

(56) References Cited

U.S. PATENT DOCUMENTS

| | | | | | |
|---|---|---|---|---|---|
| 1,204,813 | A | * | 11/1916 | Murray | 211/8 |
| 1,221,584 | A | | 4/1917 | Patrick | |
| 1,291,430 | A | * | 1/1919 | Davenport | 211/8 |
| 2,667,274 | A | | 1/1954 | Diebold | 211/64 |
| 2,710,100 | A | | 6/1955 | Vermillion | 211/4 |
| 2,946,452 | A | | 7/1960 | Caloiero et al. | 211/4 |
| 3,635,433 | A | | 1/1972 | Anderson | 248/309 |
| 3,876,076 | A | | 4/1975 | Hazelhurst | 211/4 |
| 4,027,798 | A | | 6/1977 | Swaim | 211/4 |
| 4,063,646 | A | * | 12/1977 | Stahl, Jr. | 211/4 |
| 4,300,690 | A | * | 11/1981 | Thomas | 211/4 |
| 4,696,405 | A | * | 9/1987 | Waring | 211/4 |
| 5,339,966 | A | * | 8/1994 | Bastiaans | 211/4 |
| 5,435,473 | A | * | 7/1995 | Larkum | 224/569 |
| 5,524,772 | A | * | 6/1996 | Simmons | 211/4 |
| 5,775,648 | A | * | 7/1998 | Metzger | 248/68.1 |
| 6,360,902 | B1 | | 3/2002 | Scarles | 211/70.8 |

* cited by examiner

*Primary Examiner*—Hugh B. Thompson, II
*Assistant Examiner*—Sarah Purol
(74) *Attorney, Agent, or Firm*—Gifford, Krass, Groh, Sprinkle, Anderson & Citkowski, P.C.

(57) ABSTRACT

A lockable fishing rod rack for holding a multiple number of fishing rods made of materials resisting corrosion and compatible with the environment in which a first rack member and a second rack member are slideable relative to each other so that in one position of the racks the lock can be placed in position and upon sliding movement of the racks relative to each other the rack is closed to the removal of fishing rods and can be held in that position by a lock preventing relative movement of the two rack members.

13 Claims, 2 Drawing Sheets

LOCKABLE FISHING ROD RACK

REFERENCE TO RELATED APPLICATION

This application claims priority from U.S. Provisional Patent Application Ser. No. 60/400,350, filed Jul. 31, 2002, the entire content of which is incorporated herein by reference.

FIELD OF THE INVENTION

This invention relates to racks for holding fishing rods and the like and more particularly to a rack that will hold such articles in a locked position.

BACKGROUND OF THE INVENTION

Fishing rods with their attached reels and tackle are the target of thieves. Lockable racks for holding such equipment have been provided but for the most part are complex and comprised of a multiplicity of parts. Often such racks are used in the open portion of fishing boats where they are exposed to the weather and subjected to damage and require a great deal of attention for maintenance and upkeep. Furthermore most of such racks rely on padlocks for the locking mechanism and such locks are easily misplaced or lost and more importantly can be cut and opened with the appropriate tools.

Although fishing rods are discussed in the specification, it should be understood that the fishing rod rack of this invention can be adapted to hold various elongated object such as guns, spears and the like.

SUMMARY OF THE INVENTION

It is an object of the invention to provide a rack for fishing rods that acts to hold the fishing rod in position and can be locked to prevent the unauthorized removal from the rack.

A further object of the invention is to provide a simple rack for holding a multiple number of fishing rods which utilizes a minimum number of parts.

Still another object of the invention is to provide a fishing rod rack that incorporates a push button type of lock that resists tampering with the use of usual type of bolt cutters to overcome pad locks.

Yet another object of the invention is to provide a mechanism comprised of a pair of relatively slideable members which in one position receive the fishing rod for holding it in position relative to the rack and which can be slid relative to each other to place the rack in condition for locking.

The purposes of the invention are attained by a lockable fishing rod rack for holding a multiple number of fishing rods made of materials resisting corrosion and compatible with the marine fishing environment in which a first rack member and a second rack member are slideable relative to each other so that in one position the parts are ready to receive and to hold rods in position. Upon sliding movement to a second position the rack becomes closed to the removal of the fishing rod and can be held in that position by a push button type of lock which prevents the relative movement of the two rack members.

DETAILED DESCRIPTION OF THE DRAWINGS

DETAILED DESCRIPTION

Figure 1:
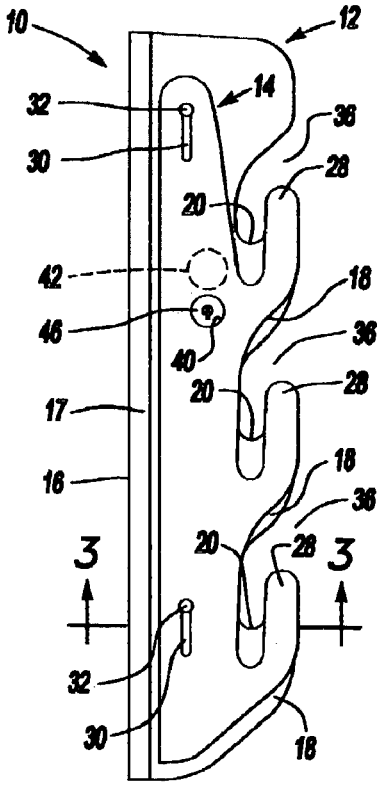
FIG. 1 is an elevation of the two major components of the lockable fishing rod rack embodying the invention in an open condition for receiving fishing rods.

Referring to the drawings, the lockable fishing rod rack is designated generally at 10 and is made up of a stationary rack member 12 and moveable rack member 14. The stationary rack member 12 is adapted to be mounted within a building or vehicle but more particularly in a boat on a generally vertical bulkhead or in an overhead horizontal position within the cabin portion of a fishing vessel. The stationary rack member 12 has a rear edge 16 which is adapted to be fitted against a wall bulkhead or ceiling and held in position by various means such as screw fasteners or adhesive to mount the device securely in position. As an example, a cleat 17 can be provided on one side of member 12 and fastened thereto by adhesive or screws, Screws 19 can be used to fasten the cleat and attached member 12 to the selected subframe.

The rack member 12 preferably is made of a plastic board material which does not require painting and is weather resistant. Opposite the rear edge 16, stationary rack member 12 is provided with a plurality of hook portions 18 and a corresponding number of bight or seat portions 20 in which horizontally disposed fishing poles can rest. Although three hook portions 18 are shown, if should be understood that a larger number or lesser number could be provided depending on the requirements and available space. Also, only one complete lockable rack 10 is required to support one end of the elongated items such as fishing poles. The opposite end of the fishing poles may be supported on hooks of a stationary rack member 12 with or without a moveable rack 14 or the need for a lock mechanism.

Figure 2:
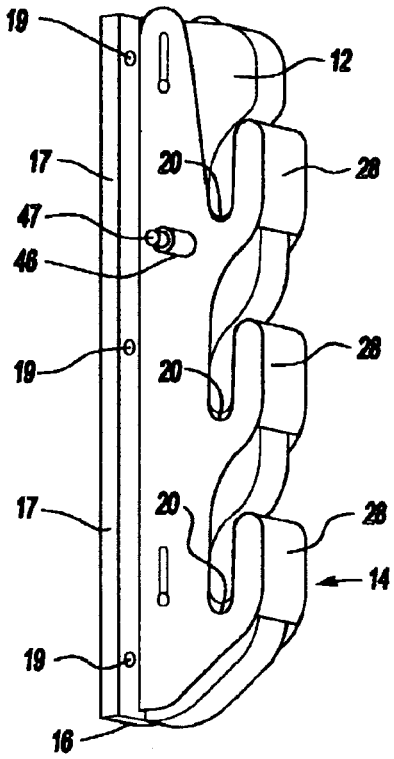
FIG. 2 is a perspective view of the structure in FIG. 1 showing another operating condition of the fishing rod rack in a closed position.
Figure 3:
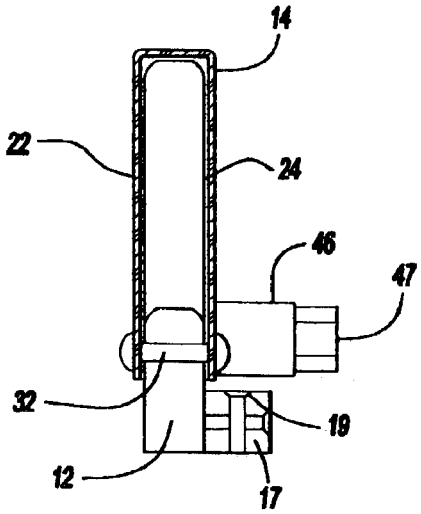
FIG. 3 is a cross sectional view taken on line 3—3 in FIG. 1.
Figure 4:
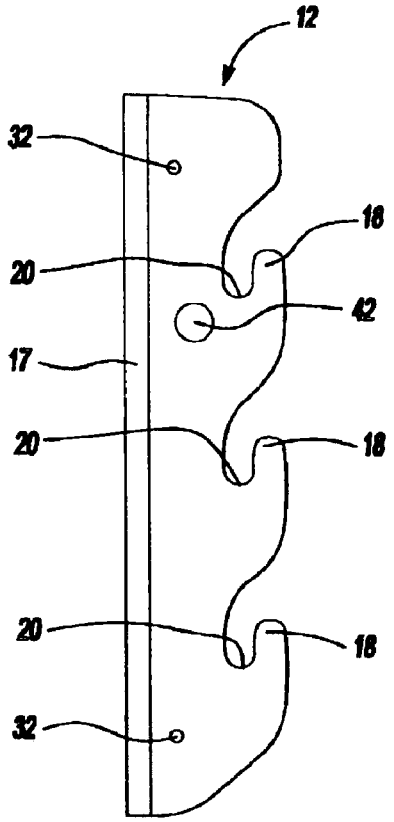
FIG. 4 is a view of the stationary component of the fishing rod rack.
Figure 5:
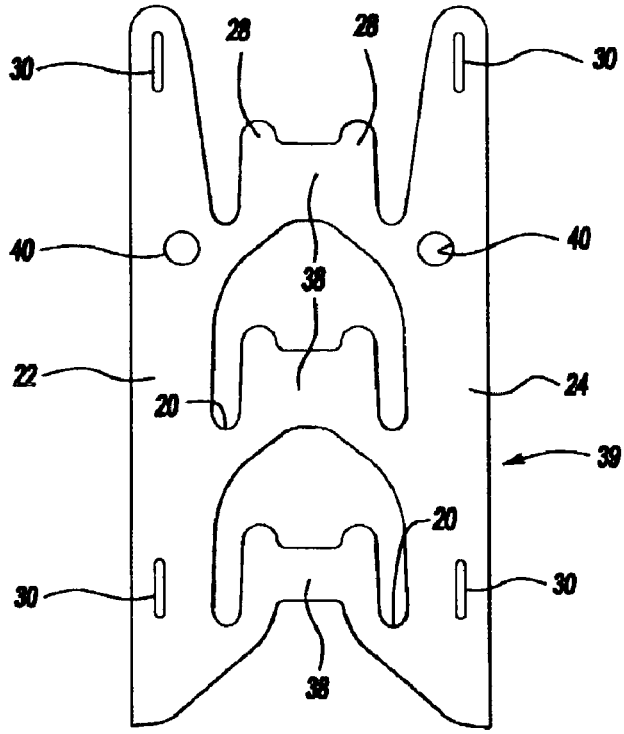
FIG. 5 is a view of the moveable portion of the fishing rod rack in condition prior to bending during manufacture.

The moveable rack member 14 forming a portion of the rack 10, is preferably made of sheet metal such as stainless steel that is bent from a flat condition seen in FIG. 5 to form a U-shaped cross-section as shown in FIG. 3 having leg portions 22 and 24 that are disposed in parallel relationship and spaced apart a sufficient distance to slidably receive the stationary rack member 12 as best seen in FIG. 1 and FIG. 2. As viewed from one side as seen in FIG. 1 and FIG. 2, the moveable rack member 14 is provided with hook portions 28 corresponding in number to the hook portions 18 on the stationary rack member 12.

The moveable rack member 14 is held in position relative to the stationary rack member 12 by means of slots 30 which receive double headed rivets 32 secured in fixed positions 34 in the stationary rack member 12 as best seen in FIG. 2. The slots 30 permit limited relative sliding movement of the moveable member 14 relative to the stationary rivets 32 in member 12 as best seen in FIG. 1 and FIG. 2. In FIG. 1 the associated hook portions 18 and 28 are in a position to accept fishing rods which can be moved into position through the opening or gaps indicated at 36. In FIG. 2 the moveable member 14 has been moved to the position closing the gaps 36 so that any rod members lying in the bight 20 of the hook portions 18 cannot be removed laterally from the rack 10.

Referring now to FIG. 5., the moveable rack member 14 is originally flat and has its sides 22 and 24 joined together by connecting portions 38 joining hook portions 28. To bring the two sides 22 and 24 into parallel relationship with each other as shown in FIG. 2, the flat member 39 is bent along the connecting portions 38 to bring the sides 22 and 24 into parallel relationship to each other. This also brings the pairs of the slots 30 and the pair of lock openings 40 into alignment.

A push button type of keyed lock 46 is used to maintain the members 12 and 14 in locked, stationary position relative to each other. For this purpose the moveable member 14 is provided with aligned openings 40 in the sides 22 and 24. The openings 40 are brought into alignment with an opening 42 in the stationary member 12 in the closed condition of the rack 10. In that condition a plug type lock or push button type lock 46 as seen in FIGS. 1, 2 and 3, can be positioned to be in the three aligned openings 40 and 42. If the lock is of the push button type it can be permanently fixed to one of the sides 22 or 24 in the associated opening 40. In the locked condition of the rack 10, the portion 47 of lock 46 is pushed to the right as viewed in FIG. 3 to interfere with the opening 42 in the stationary member 12. This reduces the exposed size of the lock to make most tools such as bolt cutters ineffective in any attempt to force opening without a key. In the case of a plug type lock (not shown) the entire lock is insertable in aligned openings 40 and 42, leaving even less structure exposed to tools attempting to force opening.

If desired, the rack 10 can be placed in condition to receive the shackle of a conventional padlock by providing aligned openings in the walls 22 and 24 of the moveable member 14 and in the stationary member 12 when the rack is in its closed Condition as seen in FIG. 2. Such a lock arrangement does not take full advantage of the security afforded by the mounting of a push button lock 46 or the use of a plug type lock.

A lockable rack for fishing poles and other elongated items has been provided in which a stationary rack member and a moveable rack member are moved relative to each other between an open, pole receiving position and a closed pole secured position. In the closed position a push button lock or plug type lock can be locked in aligned openings to prevent relative movement of the rack members with the lock substantially concealed within the rack member to prohibit access with tools in an attempt to overcome the locked condition.

What is claimed is:

1. A rack for holding elongated articles comprising:

a stationary member adapted to be fixed to a supporting surface;

a hook portion for supporting an elongated member formed by said stationary member, said hook portion having a supporting seat and a gap giving lateral access to said seat;

a lock opening formed by said stationary member;

a moveable member slidably supported relative to said stationary member and having a pair of spaced side walls disposed on opposite sides of said stationary member and forming a pair of aligned openings in said walk, said moveable member being moveable between a first position in which said gap is unobstructed and a second position in which said gap is closed by a portion of said moveable member and said lock opening in said stationary member and said pair of openings in said walls are in alignment with each other; and lock means mounted on one of said walls in alignment with said pair of openings and being in alignment with said lock opening in said stationary member when said moveable member is in said second position.

2. The rack of claim 1 wherein said walls of said moveable member are in slideable engagement with opposed sides of said stationary member during movement between said first and second positions.

3. The rack of claim 1 wherein said lock means is fixed to one of said walls in alignment with said lock opening and said opening in the other of said walls when said moveable member is in said second position.

4. The rack of claim 1 wherein said stationary member is made of a plastic board-like material.

5. The rack of claim 1 wherein said moveable member is made of stainless steel.

6. The rack of claim 1 wherein said hook portion of said moveable wall is formed by a portion of said moveable member joining the said pair of walls.

7. The rack of claim 1 wherein said stationary member has a pair of spaced apart pins with exposed end portions at opposite sides of said stationary member and said side walls form pairs of aligned slots receiving said exposed portions of said pins to permit guided sliding movement between said first and second positions.

8. The rack of claim 1 wherein said stationary member has a plurality of hook portions adjacent to each other.

9. The rack of claim 8 wherein said moveable member has hook portions an equal in number to said hook portions of said moveable member, said hook portions of said moveable member closing said gaps of said stationary member when said moveable member is in said second position.

10. The rack for holding elongated articles comprising:

a stationary member forming at least a pair of hooks each having a seat for supporting an elongated member extending transversely to said stationary member and a gap for permitting movement of said elongated member to said seat;

a moveable member having a pair of walls exposed at opposed surfaces of said stationary member and joined together by a forward wall to form a unitary structure, said moveable member being slidably supported relative to said stationary member for limited movement between first and second positions, said forward wall forming hooks corresponding to the number of hooks in said stationary member and being operative to simultaneously close all of said gaps upon movement of said moveable member to said second position;

openings formed in said stationary member and said pair of walls of said moveable member and being in alignment with each other when said moveable member is in second position; and lock means disposed in one of said openings in one of said walls for engagement with the remaining aligned openings in said members when said moveable member is in said second position.

11. The rack of claim 10 wherein said stationary member has a pair of spaced apart pins each having opposed exposed end portions at opposite sides of stationary member and said side walls have pairs of aligned openings receiving said exposed end portions of each of said pins to permit limited sliding movement between first and second positions.

12. The rack member of claim 10 wherein said moveable member is made of a single piece of stainless steel.

13. The rack of claim 10 wherein said stationary member is made of a plastic material.

* * * * *